US005520301A

United States Patent [19]

Sohn

[11] Patent Number: 5,520,301

[45] Date of Patent: May 28, 1996

[54] PLASTIC PACKAGING

[75] Inventor: Manfred Sohn, Herrenberg, Germany

[73] Assignee: Berner Kunststofftechnik GmbH, Nagold, Germany

[21] Appl. No.: 159,372

[22] Filed: Nov. 30, 1993

[30] Foreign Application Priority Data

Dec. 1, 1992 [DE] Germany ..... 42 40 327.8

[51] Int. Cl.[6] ..... B65D 39/00

[52] U.S. Cl. ..... 220/265; 220/324

[58] Field of Search ..... 220/265, 324

[56] References Cited

U.S. PATENT DOCUMENTS

| | | | |
|---|---|---|---|
| 3,539,552 | 11/1970 | Mounts et al. . | |
| 4,621,744 | 11/1986 | Foster . | |
| 4,742,935 | 5/1988 | Schellenberg . | |
| 4,782,977 | 11/1988 | Watanabe et al. | 220/324 |
| 4,974,735 | 12/1990 | Newell et al. | 220/265 X |
| 5,133,470 | 7/1992 | Abrams et al. | 220/265 X |

FOREIGN PATENT DOCUMENTS

| | | |
|---|---|---|
| 1915047 | 4/1965 | Germany . |
| 3639870 | 6/1988 | Germany . |
| 2040267 | 8/1980 | United Kingdom . |
| 2118145 | 10/1983 | United Kingdom . |

*Primary Examiner*—Steven M. Pollard
*Attorney, Agent, or Firm*—Frishauf, Holtz, Goodman, Langer & Chick

[57] ABSTRACT

A packaging of plastic material includes a cup or dish-shaped container and a cover that can be used to re-close the container after it has been opened for the first time. An indicator is provided to indicate an original sealed status of the container. The indicator includes at least one peg that is arranged and molded on the container and/or on the cover as an integral part thereof, and which, when the cover is installed on the container in the original sealed state, protrudes through a corresponding opening in the other of the container and the cover, and is riveted at its free end.

15 Claims, 5 Drawing Sheets

Fig. 3
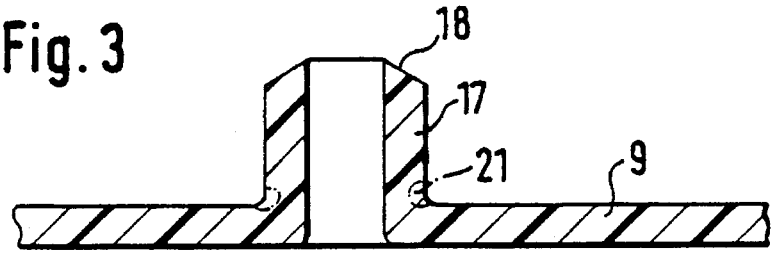
Fig. 4
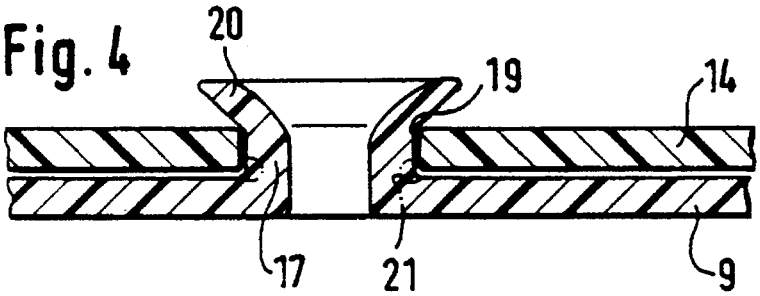
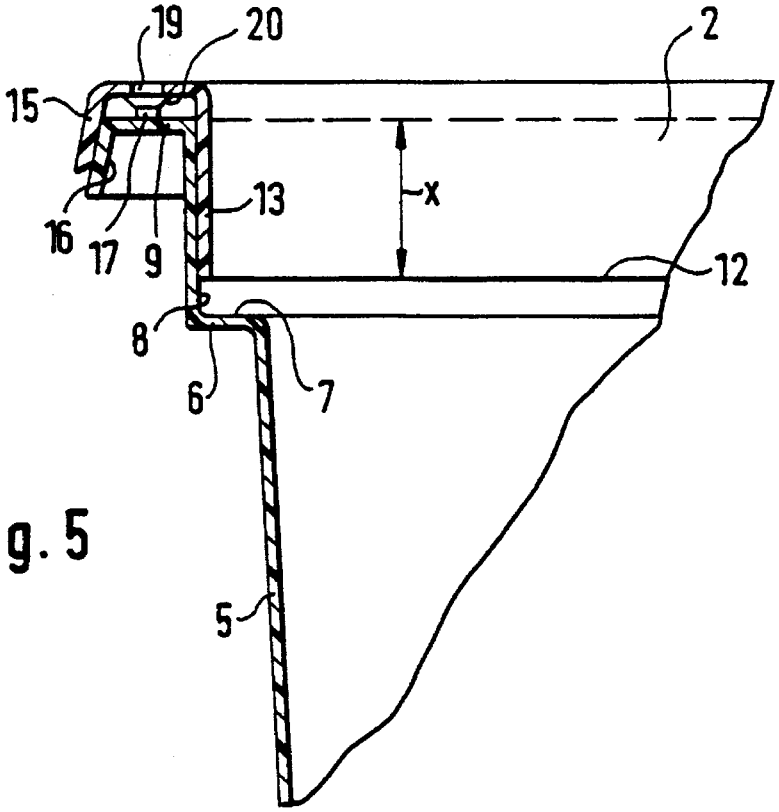
Fig. 5

PLASTIC PACKAGING

BACKGROUND OF THE INVENTION

The present invention relates to packaging that is made of plastic, and which comprises a dish or cup-shaped container, and a cover that can be installed on the container and that is intended to re-close the container once it has been opened for the first time, and means operable in conjunction with the container and the cover to indicate the original sealed state of the container.

A large number of packaging types of this kind, that are of plastic, are in wide-spread use. Without exception, these known packaging have thin walls and are manufactured from plastic film by deep drawing, by blow moulding, or by injection moulding techniques.

Mainly when packaging food stuffs, but also when packaging articles of everyday use, manufacturers place great value on the fact that after buying a filled packaging from the shelf of a retail store, the consumer has packaging that still bears the original seal. Packaging that has not been opened provides assurance with respect to hygiene and the quality of the food stuff that has been packaged, and provides an assurance that the packaging contains the specified number of items in the case of non-food articles, etc.

In order to ensure the original sealed state of the packaging, when such plastic packaging is used, special measures are required ("original sealing"), for which a number of different construction principles can be used in practice.

Thus, it is known that in so-called blister packs that a blister card or a back that is of plastic can be sealed or welded onto a deep-drawn plastic part. In a similar way, when, for instance, chicken salad or similar food stuffs that spoil easily are packaged, a sealing plate of aluminum or of the same material as the container can be sealed onto a container that is moulded from plastic; the sealing plate is so installed by the action of pressure and heat that, as a rule, it can be easily removed and after the package has been opened for the first time, it can no longer be sealed to the container. Blister packaging that is damaged or destroyed when it is opened for the first time, or a sealing plate that has been removed at least partially, provide the consumer with an unmistakable indication that the packaging is no longer in the original sealed state. Whereas when the original sealed state is maintained, the contents of the package are properly protected, temporary closure of the packaging after it has been opened for the first time is no longer possible. In those cases in which temporary re-closure is required, a dedicated re-closing cover must be enclosed with the packaging, and this entails additional expenditures with respect to both cost and packaging means.

In addition, when a sealing film of aluminum or another material that is not the same as the material used for the container is used, the packaging then becomes two-material packaging, which is at odds with the efforts being made to achieve simple recycling of packaging material that is becoming increasingly important today.

More favourable conditions with respect to the re-use of packaging material that has been used result in the case of other known plastic packaging that consists of a plastic container or lower section and a plastic cover, when the original sealed state is ensured by the use of a self-adhesive label that is affixed to the cover and to the container. Other embodiments are used, in which the edge of the cover is so configured that, together with the edge of the container, it is sealed vertically, so tightly that the cover cannot be removed from the container unless one uses a specially provided opening that, in the original sealed state, is closed off by a label or a plastic strip. The fundamental disadvantage of such solutions lies in the fact that, on the one hand, it is difficult to so configure a self-adhesive label that it cannot be removed and then re-attached if sufficient care is used, and, on the other hand, a different type of material is introduced into the packaging by the use of such a label.

There is also plastic packaging in which a cover is slipped onto the container, this then snapping into position as a result of appropriate configuration of the container and/or the cover edge. Only after removal of a lower cover edge area that is joined to it through a nominal break line can the cover be removed when the container is opened for the first time. In order to prevent such an original closure from being defeated by a user in that the container wall is pressed inward (elastically), until the cover can be removed without tearing off the lower edge section of the cover, the container must have relatively thick walls. It is true that such containers are acceptable for pharmaceuticals or cosmetics, but because of the costs involved they are not used for packaging a number of consumer food stuffs.

Finally, it is known that when such plastic packaging is used, the cover can be provided with a tear-off tab that is torn off or removed along a defined nominal break point or line when the container is opened for the first time. As a rule, covers that are configured in this way can only be produced by injection moulding; they are too costly for many single-use items.

For this reason, it is the object of the present invention to create plastic packaging that provides a solution to the problem of the so-called original sealing and which is as reliable and cost-effective as possible.

SUMMARY OF THE PRESENT INVENTION

In order to solve this problem, the packaging described in the introduction hereto is characterized in that the means used to indicate the original sealed status incorporate at least one peg that is formed on the container and/or the cover and arranged on one part and which, in the original sealed state with the cover installed, extends through a corresponding opening in the other part and is then riveted to this part at the end.

The peg can be configured so as to be solid or, preferably, as a hollow peg, in which connection it has at the end a rivet head that overlaps the opening. In the case of a hollow peg, the riveting can be effected by using a mandrel or drift so that a rivet head that widens out in the shape of a funnel is formed.

The arrangement is such that when the container is closed at least one peg is riveted, so that an undamaged rivet is a clear indication that the original sealed status is still maintained. When the container is opened for the first time, the peg is either torn off-to which end it can if necessary incorporate a nominal break point-or else the diameter of the opening is so matched to the "rivet head" that although the cover can be removed when the container is opened it can no longer be re-riveted when the cover is re-installed. Once the cover has been opened for the first time, the consumer can see that the opening is seated on the rivet head which means that the original sealed state is no longer in effect.

This new packaging is characterized in that the original seal requires no additional materials or parts. The packaging that is secured remains in two parts without additional connecting aids such as labels or the like. Since at least one peg is formed from the material of the container and/or the cover it can be ensured that the packaging is still made of one material, which can be manufactured in the known manner from easily recyclable plastics, such as polypropylene.

At the same time, manufacture of the packaging parts, namely of the container and of the cover, including the new original sealing is possible without any significant increase in production times so that there is no significant increase in costs compared to known packaging without such original sealing. The packaging can be produced on conventional packaging machinery and processed by these without the need for new procurement or additional equipment, which result in higher costs. Because of the fact that the pegs are of a relatively small diameter and can be arranged at any suitable point on the container and/or the cover, the concept of the present invention is not restricted to a specific container or cover shape. There can also be cases in which at least one such peg can be arranged, for example, on the side of the container and function in conjunction with an overlapping tab or an overlapping edge of the cover that contains the appropriate associated opening.

When an aluminum or plastic sealing plate is hot-sealed by known methods onto the container in order to produce an original seal, heat has to be applied and then immediately conducted away, mainly to protect food stuffs from spoiling; in contrast to this, the small pegs can be riveted with scarcely any thermal loading of the packaging material. Depending on the packaging material that is used, this riveting can be effected either cold or hot. Of course, the new packaging can be imprinted and decorated by the use of labels without any problems, and without any interference being caused by the pegs or the riveting thereof.

The peg can be of any desired cross-section; it is expedient if the peg is cylindrical. In a preferred embodiment, each of the pegs is oriented so as to be essentially perpendicular to the edge of the container in order that it can be secured when the cover is installed in a vertical direction on the filled container in the conventional manner, with the peg located in the associated opening in the other part.

As has already been noted, the selection of the best place to arrange the peg or pegs depends on the configuration of the container and of the cover. In the case of the usual cup or dish-shaped container it is, as a rule, advantageous if riveted pegs are provided on at least two opposing sides of the container edge.

However, there are other versions of the packaging which, for example, can originally be provided with a tear-off tab and in which it is then possible to arrange at least one riveted peg in such a tear-off tab.

Very frequently, it is required that once the container has been opened for the first time, the cover must be re-installable in order that the contents of the container can be used little by little. Despite this, the consumer must be made aware of the fact that the packaging has already been opened previously. In order to achieve this, the cover can incorporate an all-round sealing lip that faces towards the interior of the container and which, when the cover is installed, lies on a sealing surface of the container so as to form a seal surface. When this is done, as a rule, the width of the sealing lip measured in the direction of the bottom of the container is greater by a pre-determined amount than the length of the riveted peg, in order to ensure that when the container is re-closed after being opened for the first time, the sealing lip seals the interior of the container effectively while the cover rests on the rivet heads.

Finally, taking fully automated packaging into account, which requires unstacking and filling the containers by machine and machine capping of the container, it is an advantage if the empty containers can be formed into a stack that when the containers are so stacked the pegs are located in the free space between adjacent containers.

BRIEF DESCRIPTION OF THE DRAWINGS

The drawings show embodiments of the object of the present invention. FIG. 3 shows a peg of the original seal of the packaging shown in FIG. 1, in cross-section on the line III—III in FIG. 2, in a side view, at a different scale; FIG. 4 shows the peg shown in FIG. 3 when riveted, in a view corresponding to the cross-section on the line IV—IV in FIG. 2; FIG. 5 a partial side cross-sectional view of the container shown in FIG. 1, when re-closed after having been opened for the first time.

DETAILED DESCRIPTION

Figure 1:
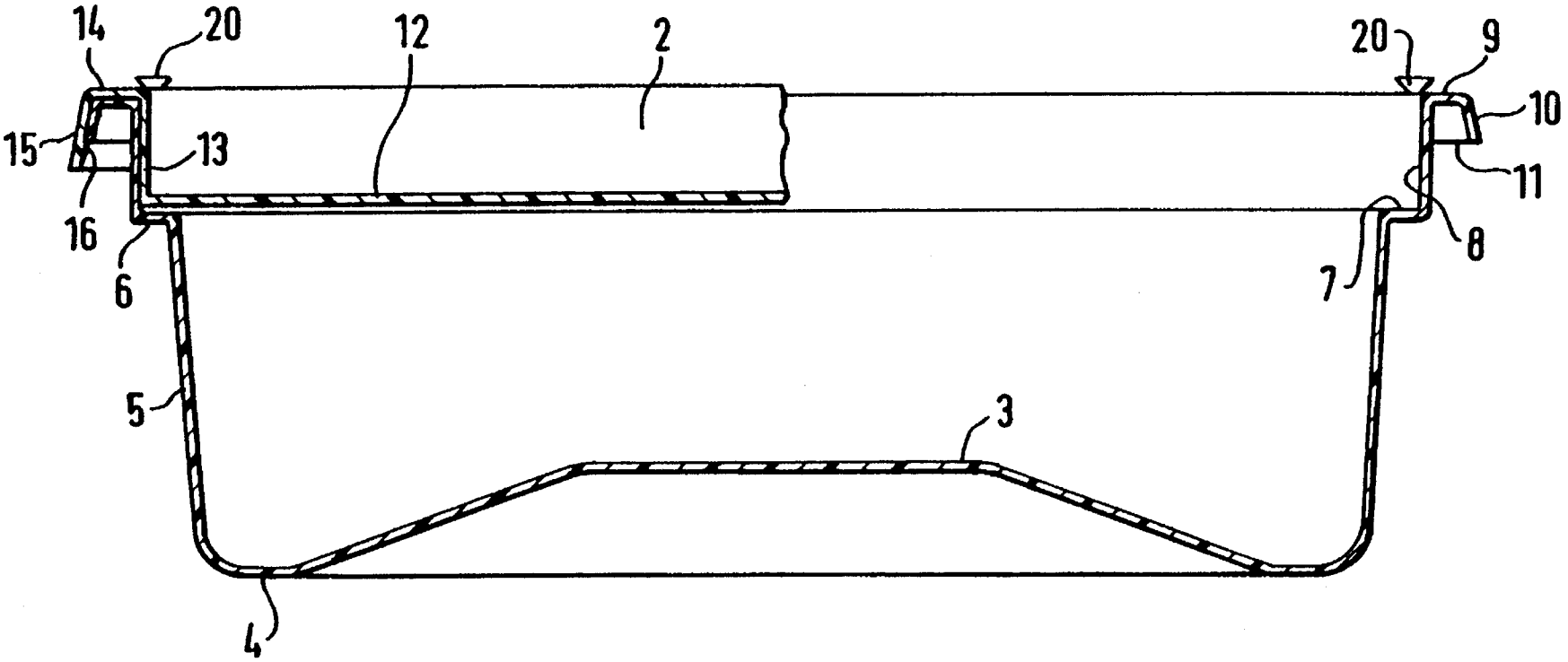
FIG. 1 shows a side cross-sectional view of a packaging unit according to the present invention, shown in part, with the cover installed and with the original seal, and shown in part with the cover removed.
Figure 2:
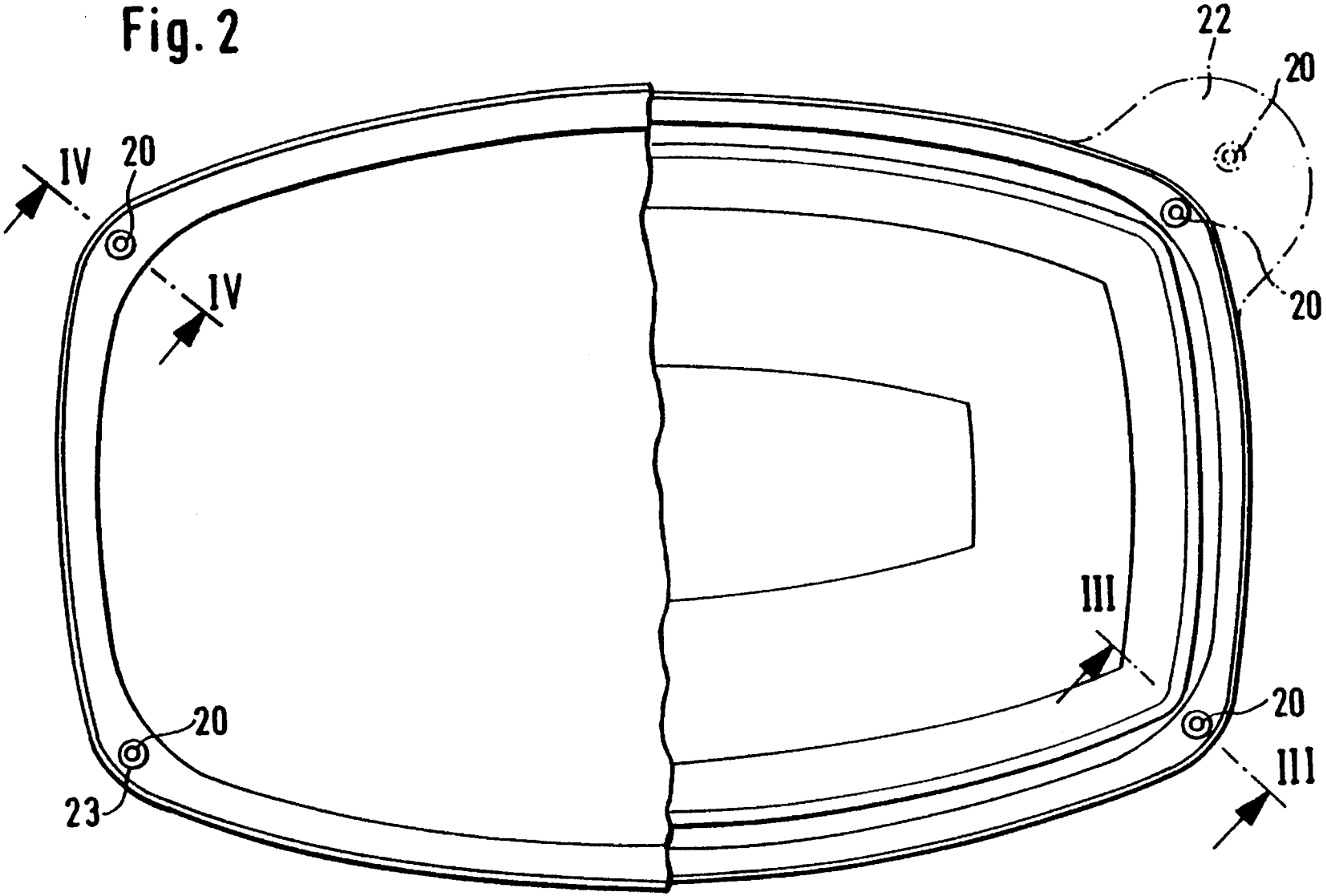
FIG. 2 is a top plan view of the package as shown in FIG. 1.

The plastic packaging shown in FIGS. 1 and 2 comprises an essentially cup-shaped container 1 that is of more or less oval cross-sectional shape and a slip-on cover 2 that is used to close this container, the cover 2 being installable on the container 1 so as to seal it. Both the container 1 and the slip-on cover are produced from a suitable plastic by injection moulding.

The container 1 has a bottom 4 that is elevated at 3 and an enclosing side wall 5 is adjacent to the bottom 4; at the end of the side wall 5 there is a horizontal annular flange 6 that forms an annular enclosing shoulder 7 that projects outward. On the outside, an enclosing essentially straight vertical sealing surface 8 is adjacent to the annular flange 6 and the inclined side wall 5 subtends a small acute angle with this vertical sealing surface 8. At the end, the sealing surface makes a transition to become an enclosing flat horizontal edge surface 9 that is formed in the manner of an annular surface 10 that is bent downward and outward. The surface 10 that is of a slight conical inclination ends at 11 with a straight enclosing face surface.

The cover 2 is configured so as to have a flat cover surface 12 to which an enclosing, essentially vertical, sealing lip 13 is adjacent; when the cover is installed in the manner shown on the left-hand side of FIG. 1, sealing lip 13 this lies on the inner sealing surface 8 of the container 1 so as to form a seal. At the top, the sealing lip 13 is connected to a moulded-on enclosing annular surface 14 and at the outside this makes a transition to become an enclosing flange 15 that has in the area of its unattached edge an enclosing bead 16. When the cover 2 is installed, the annular surface 14 of the cover 2 rests on the surface 9 of the container 1, whereas the bead 16 fits under the face edge 11 of the container under tension so that the cover is held securely and tightly against the container edge. The cover surface 12 is spaced slightly away from the shoulder 7 in the axial direction, as can be seen in FIG. 1 (left-hand section).

All that is required to open the container is that the flange 15 is pressed elastically outward so that the snap-fit of the bead 16 is released, whereby the cover 2 can be lifted from the container 1.

On four opposing sides of the container 1 that lie opposite each other in pairs, hollow pegs 17 are formed on the container edge in its "corners," and pegs are arranged so as to project vertically upwards from the annular surface 9, as can be seen in the section of the container that is shown in FIG. 3. The hollow peg 17 is tapered so as to be cone-shaped at the end, at 18. The axial length is such that its length is about twice the length of the wall thickness of the cover 2 in the edge area.

Within the cover 2, in the area of its annular surface 14, there are cylindrical holes or openings that correspond to the hollow pegs 17 when the cover is installed and the associated hollow pegs 17 extend through these holes or openings when the cover 2 is installed.

Once the container has been filled and the cover 2 has been installed as is shown in the left-hand side of FIG. 1, the original sealed status is secured in that the cover 2 is riveted to the container 1. To this end, the hollow pegs 17 are expanded so as to be funnel or mushroom-shaped to the outside, as can be seen in FIG. 4, it being possible to effect this by a simple pressing process, with or without the use of a drift or mandrel. For practical purposes, this riveting is carried out using conventional packaging machinery such that prior to being filled, the container 1 is picked up in the usual manner in metal or plastic frames, on which it is supported at its outer U-shaped bent edge area at 9, 10. After the filling process, the cover 2 is installed mechanically on the container 1, and the hollow pegs 17 extend through the holes 19. Then, the hollow pegs 17 are expanded and riveted, as in FIG. 4, by appropriate pressure of the so-called cover emplacing machine that is used on the container edge, which is supported in a stable manner on the aforementioned frames. Fundamentally, it is also possible to complete this riveting process in a dedicated riveting station that follows the cover emplacing station.

When the cover is introduced onto the container 1, its sealing lip 13 acts in conjunction with the sealing surface 8 as a centering means so that in each case the cover is installed in the correct position such that the hollow pegs 17 are correctly located in the holes 19.

The diameter of each of the holes 19 relative to the diameter of the associated hollow pegs 17 is selected in such a way that during the pressing or riveting process, the resulting "mushroom head" or rivet head 20 extends radially beyond the edge of the hole such that a secure riveting of both the surface areas 9 and 14 is ensured. On the other hand, the appropriate selection of this relationship of the diameters ensures that the cover 2 can be removed from the container 1 despite the riveting. During the removal of the cover 2 the rivet heads 20 deform elastically in an appropriate manner and then pass through the associated holes 19, so that the cover 2 is released. When the cover is re-installed, the rivet head 20 can no longer pass through the associated hole 19. This results in the condition shown in FIG. 5, in which the annular surface 14 of the cover rests on the rivet heads 20 of the four hollow rivets 17. The fact that the cover 2 is now no longer "riveted" to the container 1 is a sure sign that the original sealed state no longer exists.

In order to ensure a specific sealing of the interior of the container when the cover 2 is re-installed, the width of the sealing lip 13 as measured in the direction of the bottom of the container is such that it is greater by the dimension "X" shown in FIG. 5 than the axial length of the riveted hollow pegs 17. The inside lip 13 is so wide or "deep," that, as has already been noted, when the cover 2 is installed, it is centered relative to the container 1 and the required tolerances in the dimensions of the particular hole 19 with respect to the associated hollow peg 17, made necessary for reasons of production technology, are bridged.

The use of hollow pegs 17 for the aforementioned riveting entails the advantage that only a small mechanical force is required to spread the moulded hollow pegs 17, in order to achieve cold deformation such that the hollow pegs widen out in a mushroom head above the cover area at 20, as is shown in FIG. 4. Fundamentally, however, it is also possible to use embodiments in wherein moulded solid pegs are used and which the conventional approximately hemispherical rivet heads can be formed, either hot or cold, once the cover 2 has been installed.

Whereas, in the embodiment described heretofore, when the cover is removed, the rivet heads 20 can slip through the associated holes 19 elastically, it is also possible to use designs in which the rivet heads 20 are of such a diameter or the material of the cover 2 is so non-elastic that it is impossible for them to slip through the holes in this way. In this case, it is possible that when the cover 2 is opened for the first time, the rivets are simply torn off in the area of the particular shank. To this end, the pegs can be formed with nominal break points as is indicated by the dashed line shown in the hollow pegs 17 in FIGS. 3 and 4, at 21. Taking automatic packing machinery into consideration, it is preferred that the hollow pegs 17 be arranged so as to be erect on the edge of the container 1 and the cover 2 be provided with the holes 19. In particular cases, however, it can also be advantageous to reverse this, and form the hollow pegs on the cover 2, and the container edge will incorporate the holes 19. The number of rivet points along the edge of the container 1 depends on the configuration of the container. In the present case, it is sufficient to have four rivet points, as shown, these then being located opposite each other in pairs.

Depending on the particular configuration of the packaging, it is possible to provide fewer or more rivet points; it must however be ensured in each particular case that the cover 2 cannot be removed from the container 1 when it is first opened without at least one part of the riveting being irreparably separated.

In packaging whose cover is provided with a tear tab it can be expedient to provide riveting in the area of this tab, as is shown in FIG. 2 at 22. The tear tab 22 is associated with a corresponding tab on the edge of the container 1, so that, fundamentally, the relationships shown in FIG. 4 will result.

Figure 7:
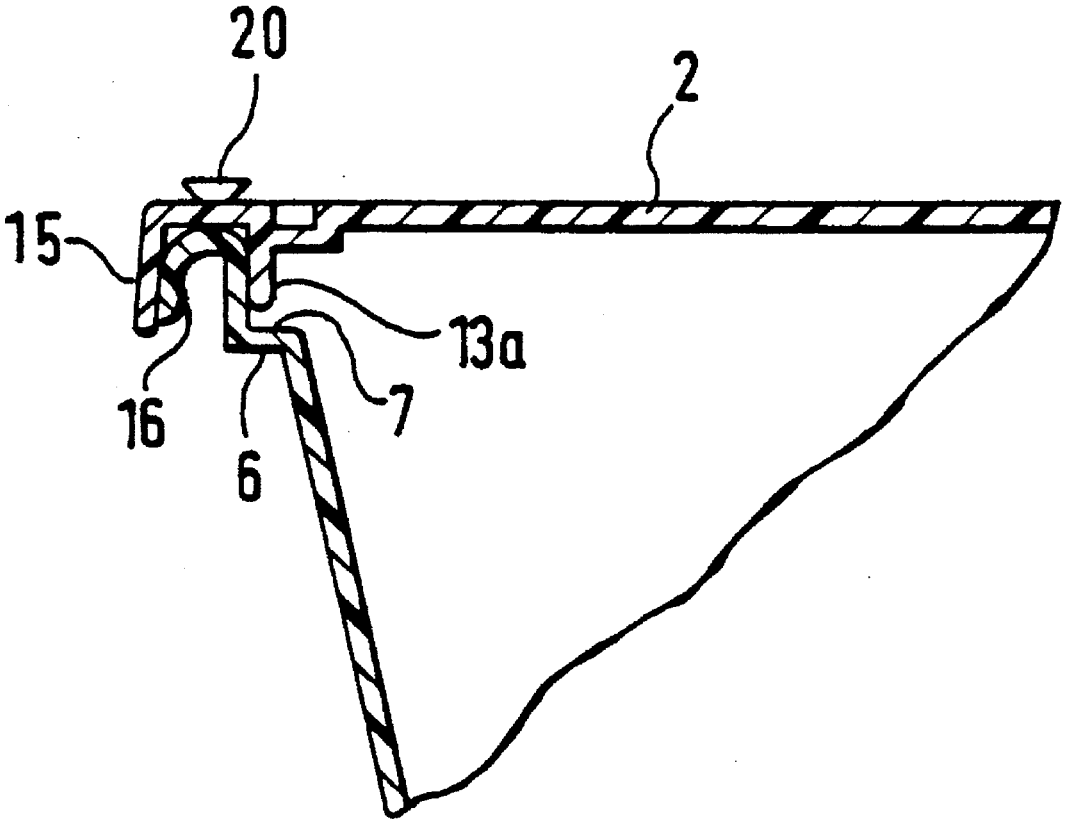
FIG. 7 shows a partial side cross-sectional view of a modified packaging unit according to the present invention, at a different scale.

Whereas in the embodiment that has been described the sealing lip 13 is configured as an annular shoulder in the cover 2, the present invention can, of course, use such cover constructions in which the inner or sealing lip **13*a* is formed so as to be "free standing," as is shown in FIG. 7**. Identical or corresponding elements bear same reference numbers as are used in the embodiments described heretofore, so that further description is unnecessary.

In order to permit simple first-time opening of the container even when a tough or non-elastic material is used to manufacture the packaging, it can also be expedient to provide a nominal break point in the part that contains the particular hole 19—here the cover 2—said break point being arranged starting from hole 19 or in the vicinity thereof, as is shown in FIG. 2 at 23. This nominal break point then permits the hole 19 to "tear out" during the first opening, or else permits the whole of the area that contains the hole 19 to break out.

Figure 6:
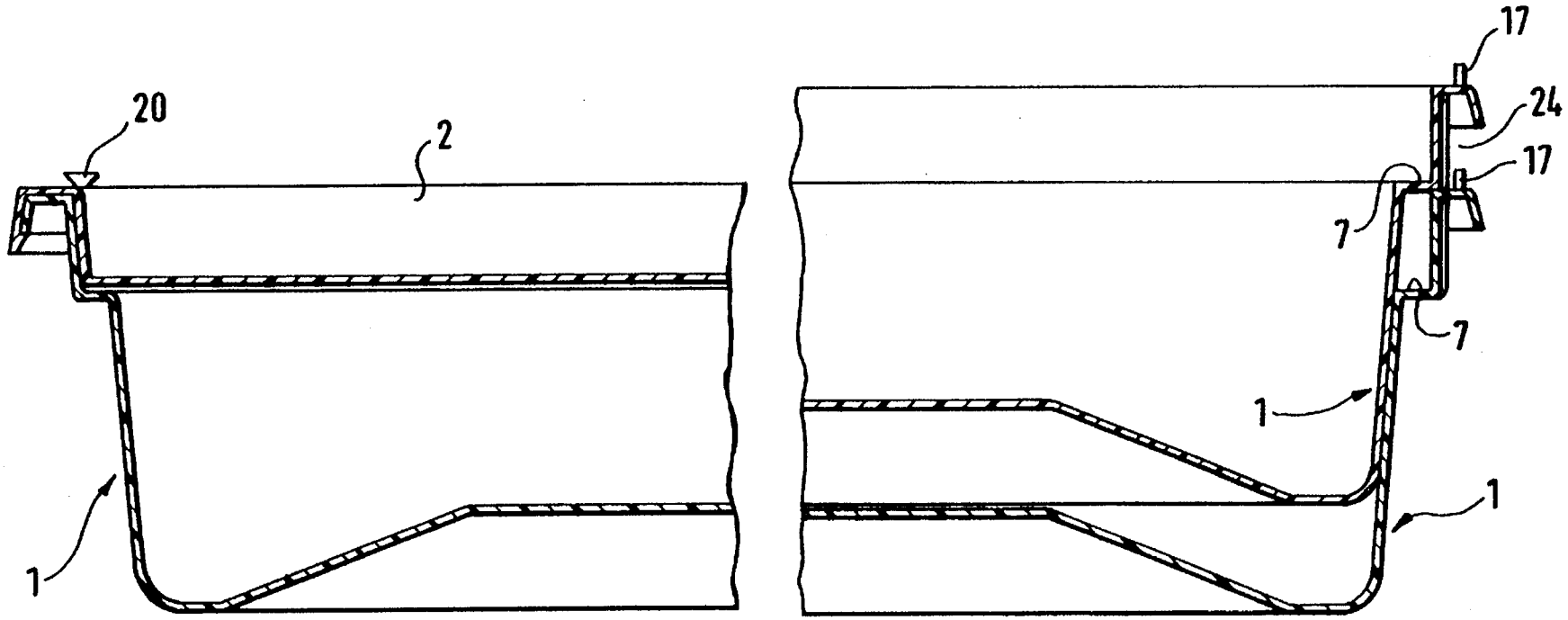
FIG. 6 shows two containers, stacked one inside the other, of the packaging shown in FIG. 1, compared to a container closed by the cover in the original sealed state in axial cross-section, in a side view and in section.

When the container and the cover are to be handled by machinery it is necessary to stack them prior to filling. This stacking process must not be prevented by the hollow peg 17. This is not the case in the embodiments of the container 1 and the cover 2 described heretofore. As FIG. 6 shows, the moulded pegs 17 each protrude into the free spaces 24 between adjacent containers 1 within the stack which in their turn are supported on each other in the area of their annular shoulder 7. The lip 13*a* is shorter than the edge 15, so that the cover 2 can be stacked.

I claim:

1. A packaging made of plastic, comprising:

a cup or dish-shaped container;

a cover that is mountable on the container to close the container, and which can be re-installed on said container after the cover has been opened for the first time, said covering being separate from and not integrally formed with said container, wherein said container and said cover are made from the same material; and indicating means on at least one of the container and the cover for indicating an original sealed or closed state of the packaging with the cover on the container;

said indicating means comprising at least one peg (17) arranged and formed in one piece with one of the container (1) and the cover (2), and wherein said at least one peg, in the original sealed or closed state of the packaging with the cover on the container, protrudes through a corresponding opening (19) on the other of the container and the cover, and wherein a protruding portion of said at least one peg (17) being widened to a dimension larger than a dimension of the opening (19) through which said at least one peg (17) protrudes, wherein at least one of the edge area of the opening and the widened protruding portion of said at least one peg (17) is resilient, so that said widened protruding portion of said at least one peg (17), which remains undamaged, is passable through said opening to release the cover from the container but cannot be reinserted in a connecting manner in the respective opening (19) after being removed therefrom, thereby forming a releasable joint between the cover (2) and the container (1) which cannot be reconnected after the packaging has been opened the first time.

2. The packaging of claim 1, wherein said at least one peg is a hollow peg (17).

3. The packaging of claim 1, wherein said at least one peg (17) is provided at one end with a rivet head (20) that overlaps the opening (19) and forms said widened portion.

4. The packaging of claim 3, wherein said at least one peg (17) is cold riveted.

5. The packaging of claim 3, wherein said at least one peg (17) is hot riveted.

6. The packaging of claim 3, comprising a plurality of riveted pegs (17), and wherein said riveted pegs (17) are arranged on at least two opposing sides of the container at edge portions of the container.

7. The packaging of claim 3, wherein the rivet head (20) is one of funnel and mushroom-shaped, and spreads outward.

8. The packaging of claim 1, wherein said at least one peg (17) is oriented substantially perpendicularly to an edge of the container (9).

9. The packaging of claim 1, wherein said at least one peg (17) is of substantially cylindrical cross-section.

10. The packaging of claim 1, wherein:

the cover (2) includes a sealing lip (13, 13*a*) that faces an interior sealing surface (8) of the container, and wherein, when the cover (2) is installed on the container, the sealing lip (13, 13*a*) lies on the sealing surface (8) of the container (1) so as to seal against said sealing surface (8).

11. The packaging of claim 10, wherein the sealing lip (13, 13*a*) has a width, as measured in a direction of a bottom of the container, which is greater by a specific amount than a length of said at least one peg (17).

12. The packaging of claim 1, wherein:

the container (1) is configured so as to be stackable on other like containers; and said at least one peg (17) lies in a free space (24) between adjacent containers when said containers are stacked.

13. The packaging of claim 1, wherein:

said at least one peg is formed on the container; and the corresponding opening is formed in the cover.

14. The packaging of claim 1, wherein:

said at least one peg is formed on the cover; and the corresponding opening is formed in the container.

15. The packaging of claim 1, wherein said container has a peripheral horizontal container edge surface of substantially constant width and said cover has a peripheral horizontal surface cover surface of substantially constant width positioned above said container edge surface, and said at least one peg (17) is arranged on one of the container edge surface and the cover edge surface, and each said opening is arranged on the other of the container edge surface and the cover edge surface.

* * * * *